US006996991B2

(12) United States Patent
Gadde et al.

(10) Patent No.: US 6,996,991 B2
(45) Date of Patent: Feb. 14, 2006

(54) FUEL INJECTION SYSTEM FOR A TURBINE ENGINE

(75) Inventors: Satish Gadde, Orlando, FL (US); William Ryan, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/644,564

(22) Filed: Aug. 15, 2003

(65) Prior Publication Data

US 2005/0034457 A1 Feb. 17, 2005

(51) Int. Cl.
*F02C 7/228* (2006.01)

(52) U.S. Cl. ..... 60/776; 60/737; 60/739; 60/747

(58) Field of Classification Search ..... 60/737, 60/739, 746, 747, 748, 776
See application file for complete search history.

(56) References Cited

U.S. PATENT DOCUMENTS

| | | | | |
|---|---|---|---|---|
| 2,701,164 A | | 2/1955 | Purchas, Jr. et al. | |
| 3,158,998 A | | 12/1964 | Robinson et al. | |
| 3,763,650 A | | 10/1973 | Hussey et al. | |
| 4,292,801 A | | 10/1981 | Wilkes et al. | |
| 4,408,461 A | * | 10/1983 | Bruhwiler et al. | 60/737 |
| 4,420,929 A | | 12/1983 | Jorgensen et al. | |
| 4,548,032 A | | 10/1985 | Sepulveda et al. | |
| 5,199,265 A | | 4/1993 | Borkowicz | |
| 5,289,685 A | * | 3/1994 | Hoffa | 60/739 |
| 5,295,352 A | | 3/1994 | Beebe et al. | |
| 5,323,614 A | * | 6/1994 | Tsukahara et al. | 60/737 |
| 5,339,635 A | * | 8/1994 | Iwai et al. | 60/737 |
| 5,404,711 A | | 4/1995 | Rajput | |
| 5,410,884 A | * | 5/1995 | Fukue et al. | 60/267 |
| 5,491,970 A | | 2/1996 | Davis, Jr. et al. | |
| 5,551,228 A | | 9/1996 | Mick et al. | |
| 5,660,045 A | * | 8/1997 | Ito et al. | 60/737 |
| 5,884,483 A | * | 3/1999 | Munro | 60/739 |
| 2001/0027639 A1 | | 10/2001 | Emmons | |
| 2002/0112482 A1 | | 8/2002 | Johnson et al. | |

FOREIGN PATENT DOCUMENTS

| | | | |
|---|---|---|---|
| JP | 10-196941 | * | 7/1998 |
| WO | WO98/25084 A1 | * | 6/1998 |
| WO | WO 99/22133 | | 5/1999 |
| WO | WO 99/67529 | | 12/1999 |

* cited by examiner

*Primary Examiner*—Ted Kim

(57) ABSTRACT

A fuel system for a turbine engine for reducing CO emissions caused during fuel staging processes while the turbine engine operates at reduced loads. The fuel system may include a first premix injector assembly and a second premix injector assembly, each formed from one or more injectors. In at least one embodiment, the first premix injector includes four injectors assembled into two pairs, and the second premix injector includes four injectors assembled into two pairs. The two pairs of the second premix injector assembly may be positioned between the two pairs forming the first premix injector assembly, thereby reducing the interface between fueled and unfueled areas, which reduces CO emissions.

7 Claims, 4 Drawing Sheets

FUEL INJECTION SYSTEM FOR A TURBINE ENGINE

FIELD OF THE INVENTION

This invention is directed generally to turbine engines, and more particularly to fuel system for turbine engines.

BACKGROUND

Typically, gas turbine engines include a plurality of injectors for injecting fuel into a combustor to mix with air upstream of a flame zone. The fuel injectors of conventional turbine engines may be arranged in one of at least three different schemes. Fuel injectors may be positioned in a lean premix flame system in which fuel is injected in the air stream far enough upstream of the location at which the fuel/air mixture is ignited that the air and fuel are completely mixed upon burning in the flame zone. Fuel injectors may also be configured in a diffusion flame system such that fuel and air are mixed and burned simultaneously. In yet another configuration, often referred to as a partially premixed system, fuel injectors may inject fuel upstream of the flame zone a sufficient distance that some of the air is mixed with the fuel. Partially premixed systems are combinations of a lean premix flame system and a diffusion flame system.

During operation, fuel is injected into the combustion chamber through the injectors into three or four stages, such as a pilot nozzle, an A-stage, a B-stage, and a C-stage (for configurations having tophat injection or pilot premix features). The pilot nozzle provides fuel that is burned to provide a mini-diffusion flame injector and also provides stability for the premixed A-, B-, and C-stages. Often turbine engines are run using high levels of airflow, thereby resulting in lean fuel mixtures with a flame temperature low enough to prevent the formation of a significant amount of $NO_x$. However, because lean flames have a low flame temperature, lean flames are prone to high CO production. And because excess CO production is harmful, a need exists to limit CO emissions.

Turbine engines often operate at higher fuel to air ratios at partial loads rather than at full load. However, turbine engines are designed for full loads. Thus, nozzles designed to run at full load run excessively lean at partial loads. Inlet guide vanes (IGVs) can be used to reduce air flow through the engine at partial loads, thereby increasing the fuel to air ratio and enabling the engine to operate more efficiently through a larger range of loads. However, IGVs may only be used to restrict air flow a limited amount.

Fuel staging is used to control fuel injection at loads below which IGVs may be used effectively. Fuel staging is a process of emitting fuel from less than all of the injectors in a fuel system. By reducing the number of injectors through which fuel is ejected, the amount of fuel passed through the injectors during operation of the turbine engine at partial loads is increased, and thus, burnout is improved. However, fuel staging creates interfaces between fueled air flows and unfueled air flows. The unfueled air flows quench the flame in the combustor and cause increased production of CO at these fuel/unfueled interfaces. Thus, a need exists for reducing the amount of CO produced by turbine engines using fuel staging at partial loads.

SUMMARY OF THE INVENTION

This invention relates to a fuel system operable as a partially premixed combustor system for a turbine engine.

The fuel system is configured to allow the associated turbine engine to operate at partial load conditions while producing reduced levels of CO emissions during fuel staging operations. The fuel system may emit fuel from less than all of the injectors forming the fuel system. In addition, the fuel system is configured to reduce the interface between fueled and unfueled flows in a combustor of a turbine engine at partial load conditions to reduce CO emissions.

In at least one embodiment, the fuel system may include a first premix injector assembly including at least four injectors, which may be grouped into pairs. For instance, first and second injectors of the first premix injector assembly may be positioned adjacent to each other in the turbine engine, and third and fourth injectors of the first premix injector assembly may be positioned adjacent to each other in the turbine engine. The fuel system may also include a second premix injector assembly comprising at least two injectors. At least one second premix injector may be positioned between the first injector and the fourth injector of the first premix injector assembly, and at least another of the second premix injectors may be positioned between the second injector and the third injector of the first premix injector assembly.

In another embodiment, the second premix injector assembly may be formed from at least four injectors. The injectors may be positioned in two or more pairs. The pairs of injectors of the second premix injector assembly may be positioned between the pairs of injectors of the first premix injector assembly. By positioning the injectors of the first and second premix injector assemblies in this manner, the interface between fueled and unfueled flows may be reduced. Thus, the amount of CO emitted from a turbine engine using the instant fuel system at partial loads, such as between about 0 percent and about 30 percent, may be reduced by about 40% compared to the same engine type without the instant fuel system.

An advantage of this invention is that the amount of CO emitted from turbine engines may be significantly reduced through use of the instant fuel system. Another advantage of this invention is that the amount of CO emitted from turbine engines may be significantly reduced through use of the instant fuel system without experiencing a significant increase in temperature in the combustion chamber and related areas of the turbine engine in which the fuel system is mounted.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
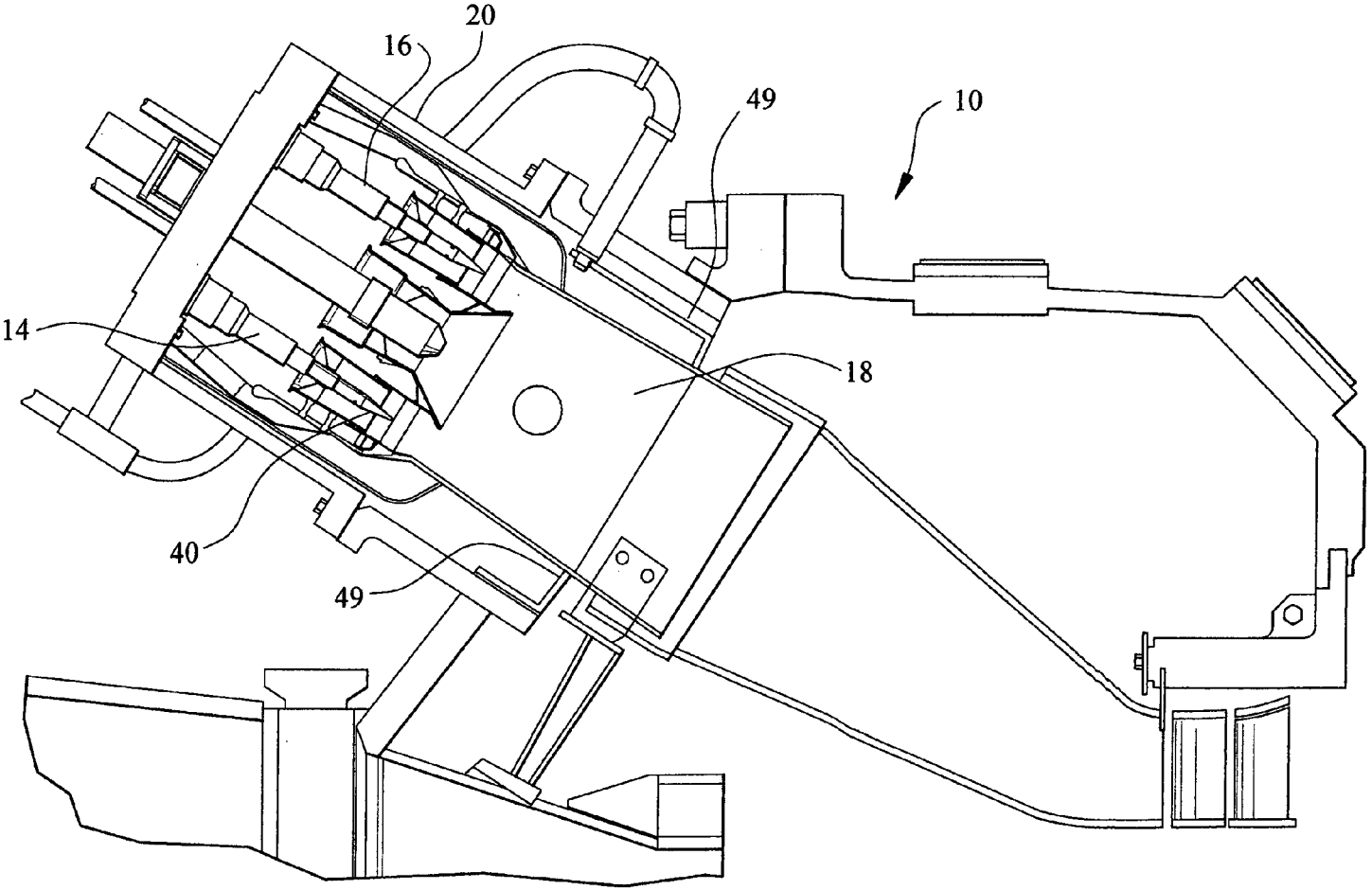
FIG. 1 is a cross-sectional view of a turbine engine including a fuel system according to the instant invention.
Figure 3:
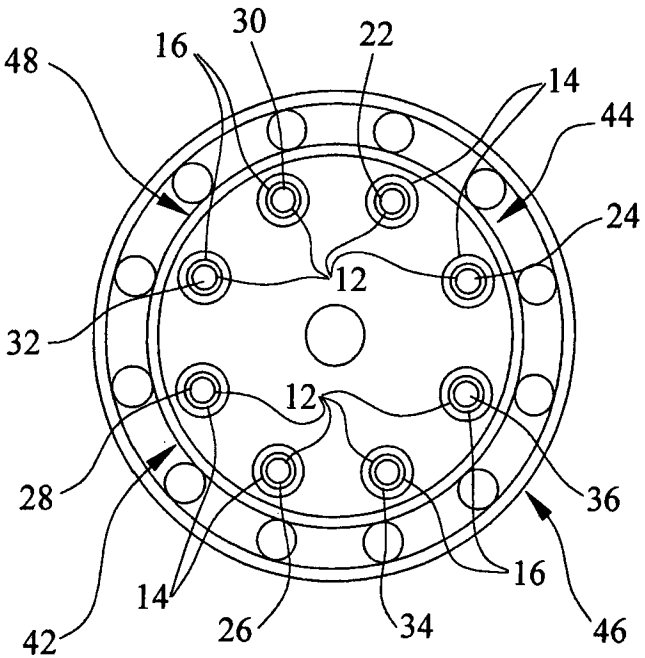
FIG. 3 is a downstream side of the fuel system of this invention.
Figure 2:
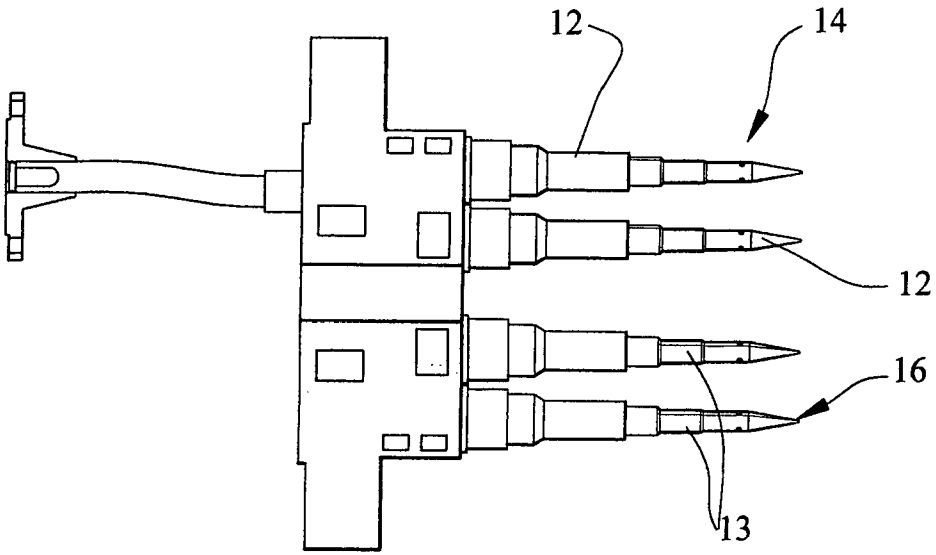
FIG. 2 is side view of a fuel system including aspects of this invention.

As shown in FIGS. 1–3, this invention is directed to a fuel system 10 for a turbine engine. In particular, the fuel system 10 is directed to a dry low $NO_x$(DLN) fuel system 10 operable as a partially premixed combustor system. The fuel system 10 is configured to allow an associated turbine engine 20 to operate at partial load conditions while producing reduced levels of CO emissions. In at least one embodiment, the fuel system 10 includes a plurality of injectors 12, as shown in FIGS. 2 and 3, for injecting fuel into a combustor 18 of a turbine engine 20, wherein the fuel system may inject fuel from less than all of the injectors 12 while the turbine engine 20 is operating at partial loads. The fuel system 10 is configured to reduce the size of the interface between the flows of the fueled injectors and unfueled injectors and thereby reduce CO emissions from the turbine engine 20.

In at least one embodiment, as shown in FIGS. 2 and 3, the fuel system 10 may be composed of a first premix injector assembly 14 and a second premix injector assembly 16, both of which may be formed from one or more injectors 12. The first premix injector assembly 14 may be formed from two or more injectors 12 positioned adjacent to each other in a combustor 18 of a turbine engine 20. The injectors 12 of the first premix injector assembly 14 may be referred to as "A" injectors. In at least one embodiment, the first premix injector assembly 14 may be formed from four or more injectors. Likewise, the second premix injector assembly 16 may be formed from two or more injectors 13 positioned adjacent to each other in a combustor 18 of a turbine engine 20. The injectors 13 of the second premix injector assembly 16 may be referred to as "B" injectors. In at least one embodiment, the second premix injector assembly 16 may be formed from four or more injectors 13. The first and second premix injector assemblies 14 and 16 may be aligned so that the injectors 12 and 13 emit fuel generally parallel to a longitudinal axis of the combustor 18. Additional C-Stage fuel injectors 49 are present.

In at least one embodiment, the injectors 12 of the first premix injector assembly 14 may be positioned in pairs, as shown in FIG. 3. In particular, first and second injectors 22 and 24, respectively, of the first premix injector assembly 14 may be positioned adjacent to each other, and third and fourth injectors 26 and 28, respectively, of the first premix injector assembly 14 may be positioned adjacent to each other. The first injector 22 and the fourth injector 28 of the first premix injector assembly 14 may be separated by one or more injectors 13 of the second premix injector assembly 16. In at least one embodiment, the first injector 22 and the fourth injector 28 of the first premix injector assembly 14 may be separated by at least two injectors 13 of the second premix injector assembly 16. Specifically, the first injector 22 and the fourth injector 28 of the first premix injector assembly 14 may be separated by a first injector 30 of the second premix injector assembly 16 and a second injector 32 of the second premix injector assembly 16.

The second injector 22 of the first premix injector assembly 14 and the third injector 26 of the first premix injector assembly 14 may also be separated by one or more injectors 13 of the second premix injector assembly 16. In at least one embodiment, the second and third injectors 24 and 26 of the first premix injector assembly 14 may be separated by at least two injectors 13 of the second premix assembly 16. Specifically, the second injector 24 and the third injector 26 of the first premix injector assembly 14 may be separated by a third injector 34 and a fourth injector 36 of the second premix injector assembly 16.

In this embodiment, as shown in FIG. 3, the first premix injector assembly 14 is formed of two separate pairs 42 and 44 of injectors 12. Each pair 42 and 44 of injectors 12 is separated from each other by a pair 46 and 48 of injectors 13 of the second premix injector assembly 16. Each injector 12 and 13 of the first and second premix injector assemblies 14 and 16 may be spaced apart from each other a substantially equal distance. Each injector 12 and 13 of the first and second premix injector assemblies 14 and 16 may be positioned about 45 degrees from each other. The injectors 12 and 13 of the first and second premix injector assemblies 14 and 16 may be positioned equidistant from a pilot nozzle 40 and form a ring around the pilot nozzle 40. In other words, the pattern established is an "AABB" configuration that may be repeated around the pilot nozzle 40.

By positioning the injectors 12 and 13 of the first and second premix injector assemblies 14 and 16 in pairs, the size of the interface 38 between flows of the injectors 12 of the first premix injector assembly 14 and the injectors 13 of the second premix injector assembly 16 is reduced. In at least one embodiment, reduction of the flow interface 38 between injectors 12 and 13 of the first and second premix injector assemblies 14 and 16 is about 50%. Reduction of this flow interface reduces the amount of CO produced during operation. In effect, the amount of area where the flame is quenched by the unfueled air flow is reduced, which thereby reduces the CO production by the combustor 18.

During operation, fuel may be emitted from one or more of the injectors 12 of the first premix injector assembly 14. Often, fuel may be emitted from all of the injectors 12 of the first premix assembly 14. At partial loads, fuel may not be emitted from one or more of the injectors 13 of the second premix injector assembly 16. By withholding emission of fuel from the second premix injector assembly 16, the injectors 12 of the first premix injector assembly 14 may be more fuel-rich, which improves burnout. The fuel system 10 may also emit fuel only from the injectors 13 of the second premix injector assembly 16 and not from the injectors 12 of the first premix injector assembly 14.

Figure 5:
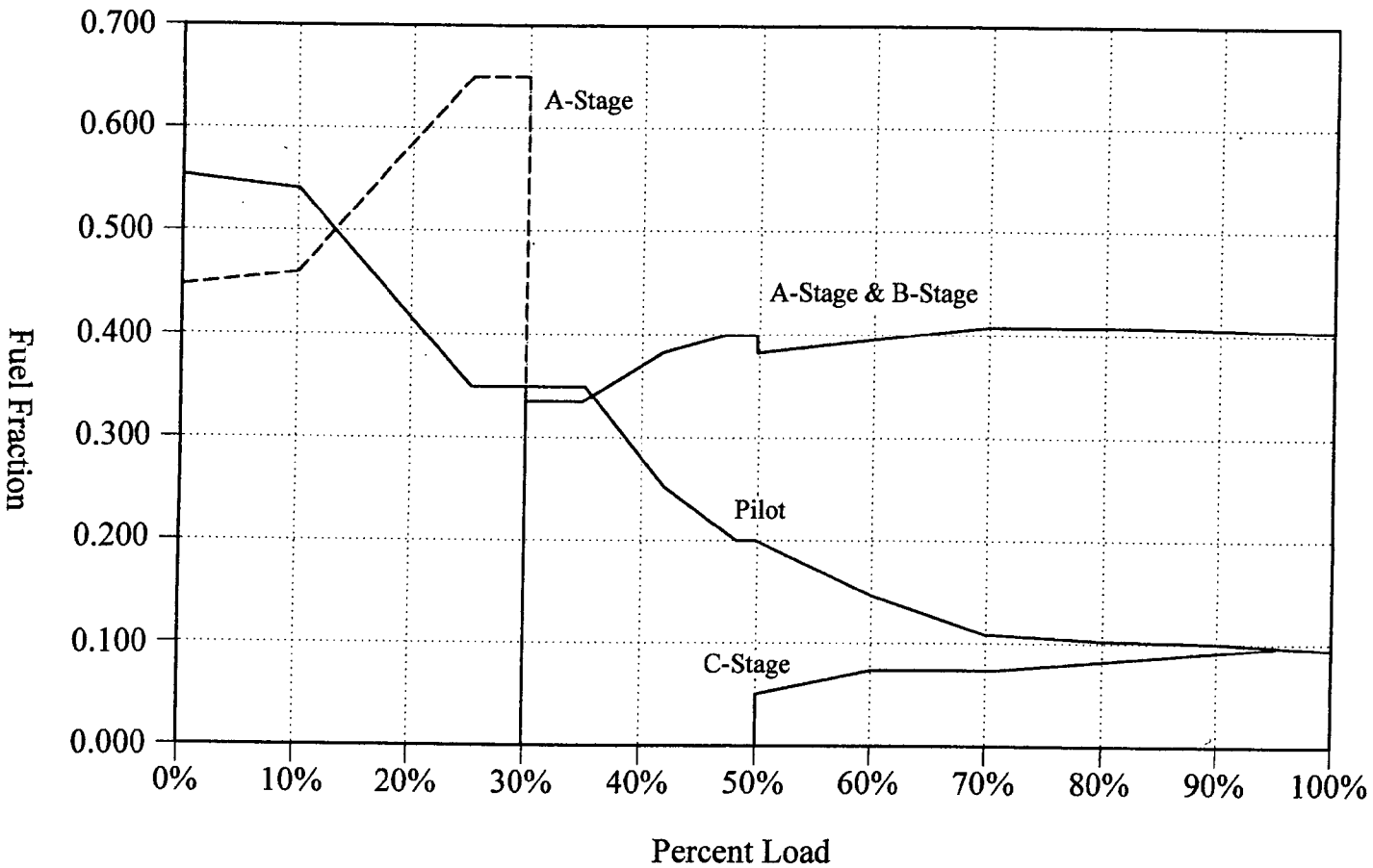
FIG. 5 is an example of a fuel staging schedule for fuel flow from injectors in a turbine engine.

Fuel staging with the fuel system 10 may be used between about 0% load and about 30% load, as shown in FIG. 5. For instance, at 30% load, approximately 65% of the fuel can be sent through the injectors 12 of the first premix injector assembly 14 and approximately 35% of the fuel can be sent through the pilot nozzle 40. The total air flow through the turbine engine 20 at 30% load may be between about 50% and about 80% of the total air flow through the turbine engine at 100 percent load. The total air flow through the engine may be divided into about 7% through the pilot nozzle 40, about 80% through the first and second premix injector assemblies 14 and 16, and about 13% leakage through the combustor 18. Fuel to air ratios may be developed using these figures; however, these exemplary quantities are provided specifically for a SIEMENS W501FDDLN turbine engine. Fuel to air ratios will change in this engine at different load conditions. In addition, turbine engines having different configurations may have different air flow patterns and thus have fuel to air ratios different than those of the above-identified embodiment. At 0% load, approximately 45% of the fuel can be sent through the injectors 12 of the first premix injector assembly 14 and approximately 55% of the fuel can be sent through the pilot nozzle 40.

Figure 4:
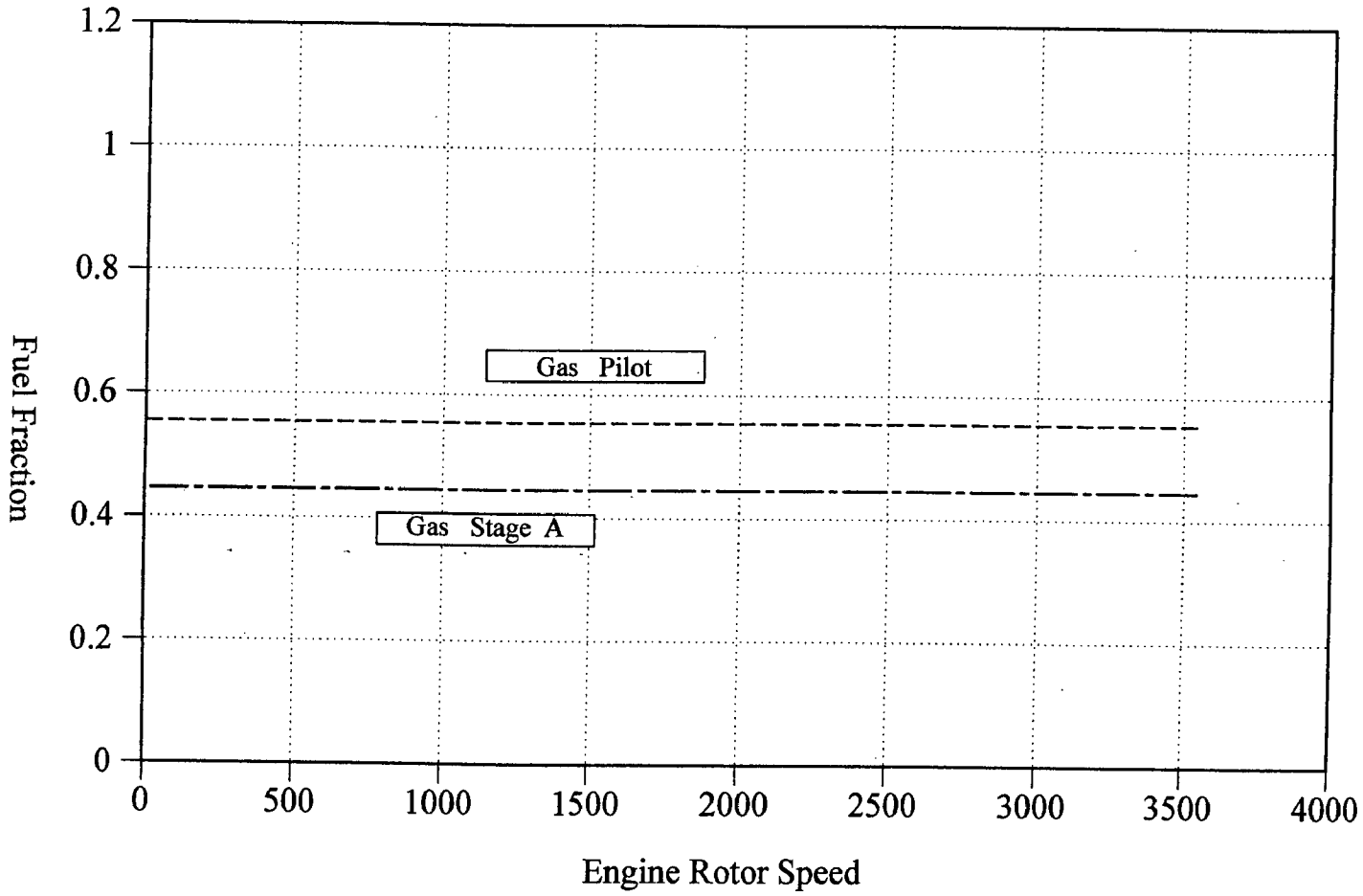
FIG. 4 is an example of acceleration fuel fractions in a turbine engine.

In the particular turbine engine described in FIG. 4, the turbine engine 20 may be ignited with a fueled pilot nozzle 40 and fueled injectors 12 or 13 of the first or second premix injector assemblies 14 or 16. Synchronization may be completed with a fueled pilot and first or second premix injector assemblies 14 or 16. Whichever of the first or second premix injector assemblies 14 or 16 is not used at start up is then fueled at 30% load.

Emitting fuel in this manner has proven to effectively reduce CO emissions. In at least one embodiment, the configuration of injectors 12 in the first and second premix injector assemblies 14 and 16 described above may reduce CO emissions from a turbine engine 20 while the turbine engine 20 is operating between about 0% load and about 30% load. In at least one embodiment of the fuel system 10, the fuel system 10 realized a reduction of about 40% in the amount of CO produced at partial loads. Furthermore, the fuel system 10 did not substantially raise the peak temperature beyond an acceptable range for the turbine engine tested.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A fuel system for a turbine engine, comprising:

a first premix injector assembly comprising at least four injectors, wherein at least first and second injectors of the at least four injectors of the first premix injector assembly are positioned adjacent each other in the turbine engine and at least third and fourth injectors of the at least four injectors of the first premix injector assembly are positioned adjacent each other in the turbine engine;

a second premix injector assembly comprising at least four injectors, wherein at least first and second injectors of the at least four injectors of the second premix injector assembly are positioned adjacent each other in the turbine engine and at least third and fourth injectors of the at least four injectors of the second premix injector assembly are positioned adjacent each other in the turbine engine;

a plurality of fuel injectors positioned radially outward from the first and second premix fuel injector assemblies;

at least one pilot nozzle, wherein the at least four injectors of the first premix injector assembly and the at least four injectors of the second premix injector assembly form a ring around the pilot nozzle;

wherein the first and second injectors forming a portion of the first premix injector assembly are positioned between the first and fourth injectors forming a portion of the second premix injector assembly and the third and fourth injectors forming a portion of the first premix injector assembly are positioned between the second and third injectors forming a portion of the second premix injector assembly; and wherein the fuel system is capable of emitting fuel into the turbine engine through the first premix injector assembly without simultaneously emitting fuel into the turbine engine through the second premix injector assembly.

2. The fuel system of claim 1, wherein the fuel system is capable of emitting fuel into the turbine engine through the second premix injector assembly without simultaneously emitting fuel into the turbine engine through the first premix injector assembly.

3. The fuel system of claim 1, wherein the at least four injectors of the first premix injector assembly and the at least four injectors of the second premix injector assembly are spaced apart from each other a substantially equal distance.

4. The fuel system of claim 1, wherein each injector of the first and second premix injector assemblies is separated from each other by about 45 degrees relative to a longitudinal axis of the combustor.

5. The fuel system of claim 1, wherein the at least four injectors of the first premix injector assembly and the at least four injectors of the second premix injector assembly are positioned substantially parallel to each other.

6. A method for fueling a turbine engine operating in fuel staging condition, comprising:

supplying fuel to a first premix injector assembly of a fuel system comprising a first premix injector assembly, a second premix injector assembly, and at least one pilot nozzle, wherein the at least four injectors of the first premix injector assembly and the at least four injectors of the second premix injector assembly form a ring around the pilot nozzle, the first premix injector assembly comprising at least four injectors positioned adjacent each other in the turbine engine and forming pairs of injectors and the second premix injector assembly comprising at least four injectors positioned adjacent each other in the turbine engine and forming pairs of injectors positioned between the pairs forming the pairs of injectors of the first premix injector assembly;

a plurality of fuel injectors positioned radially outward from the first and second premix fuel injector assemblies; and emitting fuel from the at least four injectors of the first premix injector assembly without simultaneously ejecting fuel from the second premix injector assembly.

7. The fuel system of claim 6, wherein emitting fuel from the at least four injectors of the first premix injector assembly comprises emitting fuel through at least first, second, third and fourth ejectors, wherein the first and second ejectors are adjacent each other and the third and fourth ejectors are adjacent each other and the first and fourth injectors of the first premix injector assembly are separated by at least two injectors of the second premix injector assembly and the second and third injectors of the first premix assembly are separated by at least two injectors of the second premix injector assembly.

* * * * *